US007473139B2

(12) United States Patent
Barringer et al.

(10) Patent No.: US 7,473,139 B2
(45) Date of Patent: Jan. 6, 2009

(54) UNIVERSAL EMC GASKET

(75) Inventors: Dennis R. Barringer, Wallkill, NY (US); David C. Linnell, Poughkeepsie, NY (US); Andrew Rybak, Hopewell Junction, NY (US); Harold M. Toffler, Middlehope, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 11/939,742

(22) Filed: Nov. 14, 2007

(65) Prior Publication Data

US 2008/0060842 A1 Mar. 13, 2008

Related U.S. Application Data

(63) Continuation of application No. 11/463,044, filed on Aug. 8, 2006, now Pat. No. 7,357,675.

(51) Int. Cl.
*H01R 13/648* (2006.01)

(52) U.S. Cl. ..... 439/609; 174/35 R; 174/354; 439/939

(58) Field of Classification Search ..... 174/354, 174/35 R; 439/271, 939, 609
See application file for complete search history.

(56) References Cited

U.S. PATENT DOCUMENTS 4,386,814 A * 6/1983 Asick ..... 439/607
5,959,244 A * 9/1999 Mayer ..... 174/369
6,005,186 A * 12/1999 Bachman ..... 174/377
6,280,257 B1 * 8/2001 North et al. ..... 439/680
6,359,768 B1 * 3/2002 Eversley et al. ..... 361/212
7,150,653 B1 * 12/2006 Mason ..... 439/609
7,168,971 B2 * 1/2007 Manson et al. ..... 439/271
7,258,574 B2 * 8/2007 Barringer et al. ..... 439/607
7,357,675 B2 * 4/2008 Barringer et al. ..... 439/609

FOREIGN PATENT DOCUMENTS

WO WO2007/079117 A1 * 7/2007

* cited by examiner

*Primary Examiner*—Michael C Zarroli
(74) *Attorney, Agent, or Firm*—Cantor Colburn LLP; Lily Neff

(57) ABSTRACT

An electromagnetic gasket includes a conductive shell having a pair of side walls and end walls extending therefrom defining at least one opening. The pair of side walls and the end walls have at least one outward bias and at least one inward bias positioned thereon for each opening. The outward bias is configured to electrically connect to an inner tailstock of an electrical enclosure. The at least one opening is configured to receive a connector port housing of a corresponding module therein. The at least one inward bias electrically connects the connector port housing to the inner tailstock of the electrical enclosure. Each module is an electrical module or an optical module, and the at least one inward bias and outward bias provide EMC sealing for multiple connector port housings of a plurality of modules having variable dimensions with respect to at least one of the X, Y and Z axis of the connector port housings.

19 Claims, 8 Drawing Sheets

UNIVERSAL EMC GASKET

CROSS-REFERENCE TO RELATED APPLICATIONS

This application is a continuation application of U.S. Ser. No. 11/463,044, filed on Aug. 8, 2006, the disclosure of which is incorporated by reference herein in its entirety.

FIELD OF THE INVENTION

The present invention relates generally to an EMC gasket for an electrical enclosure. More particularly, the present invention is directed to a universal EMC gasket for assembly of a tail stock bezel of an electrical enclosure with a module mounted to a printed circuit card to provide a level of EMC shielding.

BACKGROUND OF THE INVENTION

The past twenty-five or so years have seen the development of ever smaller electrical circuit components at the chip level. However, to take fullest advantage of achievements in electrical circuit miniaturization, one must package the resultant printed circuit cards containing these chips in an efficient manner. Clearly, the packaging of printed circuit cards in tight spaces is a direct logical extension of increasing chip level circuit densities. It should also be noted that the tight packaging of integrated circuit chips on printed circuit cards and the correspondingly dense packaging of the printed circuit cards is a design goal that is carried out for more than just the convenience of compactness. Compactness provides shorter distances between circuit components which, in turn, serves the very desirable goal of being able to operate the circuits effectively at higher frequencies, thus increasing the speed of numerous different forms of electrical systems, including but not limited to data processing systems.

Moreover, mainly for reasons associated with long-term system operation and reliability, it is likewise very desirable to be able to easily insert and remove these printed circuit cards even when they are disposed in very tight spaces. The insertion and removal operations are also provided as an important part of a "hot-pluggability" function which is very desirable for "on the fly" repairs, replacements, maintenance and upgrades. Accordingly, to whatever extent possible, packaging designs should be: economical to produce; function smoothly; require little or no maintenance; be producible from inexpensive, readily available materials; and be reliably operable over a large number of insertion and removal operation cycles.

Yet one other concern arises in electrical systems as circuit feature size shrinks, operating frequencies increase and packaging densities grow larger, namely, the generation of electromagnetic interference (EMI). Electronic circuit packaging designs should thus also be compatible with structures and configurations that are employed to prevent the leakage of electromagnetic interference. To whatever extent possible, packaging designs should also include structures which actually contribute positively to the containment of electromagnetic interference. There is an ever increasing problem of electromagnetic interference caused by such devices. Virtually every electronic device, intentionally or not, emits some form of electromagnetic radiation. While this condition could be tolerated when few devices existed, the increasing number of electronic devices has made the problem more acute. The problem has been exacerbated by the "improvement" in semiconductor devices which allows them to operate at higher speeds, generally causing emission in the higher frequency bands where interference is more likely to occur. This is especially true with the incorporation of optical modules operating at very high speeds. Successful minimization of the interference problem, sometimes referred to as "electromagnetic compatibility" or "EMC", generally requires that emissions from a given device be reduced by shielding and other means, and that shielding be employed to reduce the sensitivity of a device to fields from other devices. Since shielding helps to reduce sensitivity to external fields as well as reduce emissions from the device, it is a common approach to a solution of the problem.

In newer high speed packages it is necessary to use a metallic type of gasket to provide better conduction with an electrical enclosure in which the printed circuit cards are engaged. For example, optical riser card assemblies include a plurality optical modules mounted on a single printed circuit card that require an EMC gasket between the housing of the optical module and the tail stock of the electrical enclosure (e.g., a docking cassette). The tail stock of the docking cassette includes at least one opening corresponding to a cable opening of each optical module. Each optical module is commonly a receiver and/or a transmitter configured with a cable opening to receive a cable connector of a corresponding I/O cable. However, one vendor may not be able to supply all of the optical modules needed and optical modules having different mechanical packaging from other vendors may be supplied to make up for this deficit. In this case, the EMC gasket may not be compatible with differently sized optical modules from these other vendors.

It is also noted that the present discussion refers to printed circuit boards and printed circuit cards. As contemplated herein, the printed circuit board is the larger component into which at least one printed circuit card is inserted for purposes of electrical connection. The present disclosure places no specific limits on either the size of a printed circuit board or the size of a printed circuit card. In the most general situation, a circuit board will be populated with a plurality of printed circuit cards. That is, the printed board will have a number of printed circuit cards inserted therein. Accordingly, as used herein, the terms "printed circuit board" and "printed circuit card" are considered to be relative terms.

Accordingly, a need exists for a method and apparatus for a universal EMC gasket that is transparent to the size of the electrical or optical module packaging and provides EMC shielding for a variety of differently sized electrical or optical modules from different vendors. The universal EMC gasket must be mechanically stable to ensure a continuous grounding and must be designed to facilitate assembly and teardown. In addition, it is desired that the assembly and manufacturing costs for a method and apparatus for shielding electrical and optical modules having a variety of mechanical packages be reduced.

SUMMARY OF THE INVENTION

The foregoing discussed drawbacks and deficiencies of the prior art are overcome or alleviated by an exemplary embodiment of a universal electromagnetic gasket. The gasket includes a conductive shell having a pair of side walls and end walls extending therefrom defining at least one opening. The pair of side walls and the end walls have at least one outward bias and at least one inward bias positioned thereon for each opening. The outward bias is configured to electrically connect to an inner tailstock of an electrical enclosure. The at least one opening is configured to receive a connector port housing of a corresponding module therein. The at least one inward bias electrically connects the connector port housing to the inner tailstock of the electrical enclosure. Each module is an electrical module or an optical module, and the at least one inward bias and outward bias provide EMC sealing for multiple connector port housings of a plurality of modules having variable dimensions with respect to at least one of the X, Y and Z axis of the connector port housings.

In another exemplary embodiment, an apparatus for providing an electromagnetic conduction seal in a device disposed within an electrical enclosure is provided. The apparatus includes a plurality of modules mounted to a printed circuit card (PCC), each of the modules having a connector port housing; a housing bezel connected to the PCC, the housing bezel having an opening to receive each of the connector port housings therethrough so as to be associated with a corresponding cable opening; and a metal EMC gasket. The EMC gasket is defined by a conductive shell having a pair of side walls and end walls extending therefrom defining at least one opening. The pair of side walls and the end walls have at least one outward bias and at least one inward bias positioned thereon for each opening. The outward bias is configured to electrically connect to an inner tailstock of an electrical enclosure. The at least one opening is configured to receive a connector port housing of a corresponding module therein. The at least one inward bias electrically connects the connector port housing to the inner tailstock of the electrical enclosure. Each module is an electrical module or an optical module, and the at least one inward bias and outward bias provide EMC sealing for multiple connector port housings of a plurality of modules having variable dimensions with respect to at least one of the X, Y and Z axis of the connector port housings.

BRIEF DESCRIPTION OF THE DRAWINGS

Referring now to the figures, which are exemplary embodiments, and wherein the like elements are numbered alike.

DETAILED DESCRIPTION OF THE INVENTION

Referring generally to the figures, a docking apparatus 10 for mounting a printed circuit board (PCB) into a computer system is shown, in accordance with an embodiment of the invention. Docking apparatus 10 preferably provides structural support to the PCB so as to allow for the easy insertion and removal of the PCB from a computer system, as well as thermal and electrical isolation from other PCB's and components within the computer system. It will also be noted that although the present invention will be described with reference to providing a universal EMC gasket with respect to docking apparatus 10 and a computer system, that the present invention may be employed with other devices in conjunction with an electrical enclosure.

Figure 1:
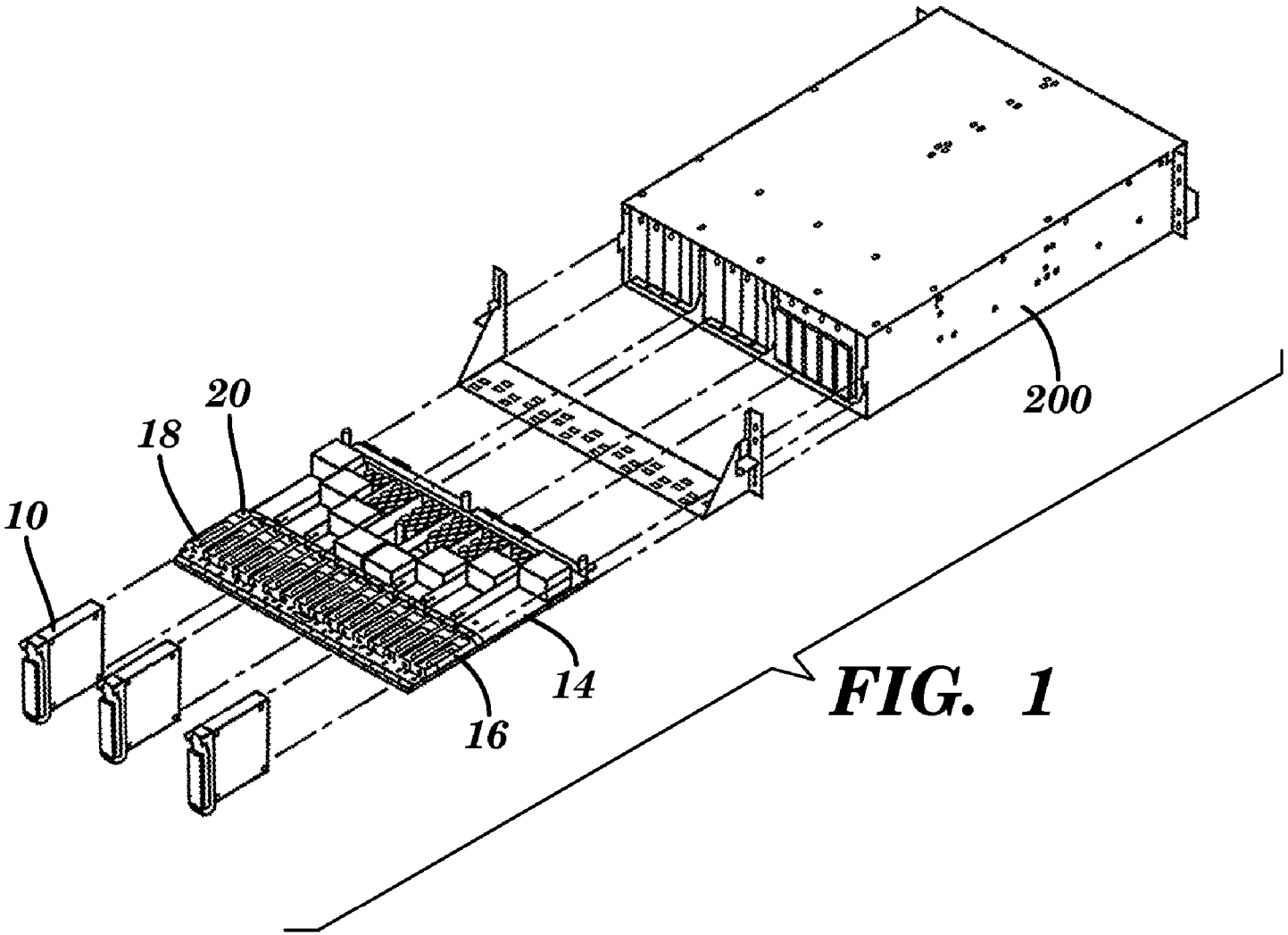
FIG. 1 is an exploded overall view of a plurality of docking cassettes and a computer system in accordance with an embodiment of the invention.

Referring generally to FIG. 1, a docking apparatus or cassette 10 for mounting a printed circuit card (PCC) into a computer system 12 is shown, in accordance with an embodiment of the invention. Docking apparatus 10 preferably provides structural support to the PCC so as to allow for the easy insertion and removal of the PCC from computer system 12, as well as thermal and electrical isolation from other PCC's and components within the computer system.

Docking cassette 10 is disposed onto a computer system main board 14 or main printed circuit board (PCB) having a PCB connector receptacle 16, a first receptacle 18 and a second receptacle 20. Docking apparatus 10 is preferably disposed onto computer system main board 14 such that a PCB connector is adjacent to PCB connector receptacle 16. In addition, main board 14 is slidably engaged with a cable tray 22 for releasably supporting and securing computer system 12 in a system rack (not shown).

Figure 2:
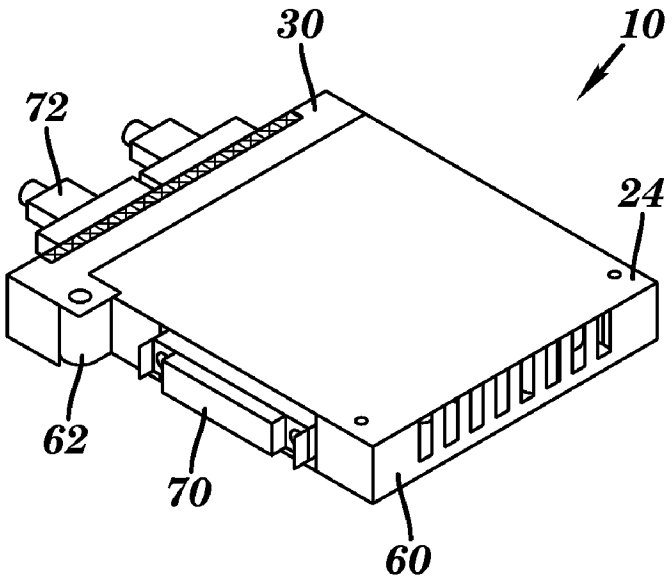
FIG. 2 is a perspective view of a single docking cassette in accordance with an embodiment of the invention.
Figure 3:
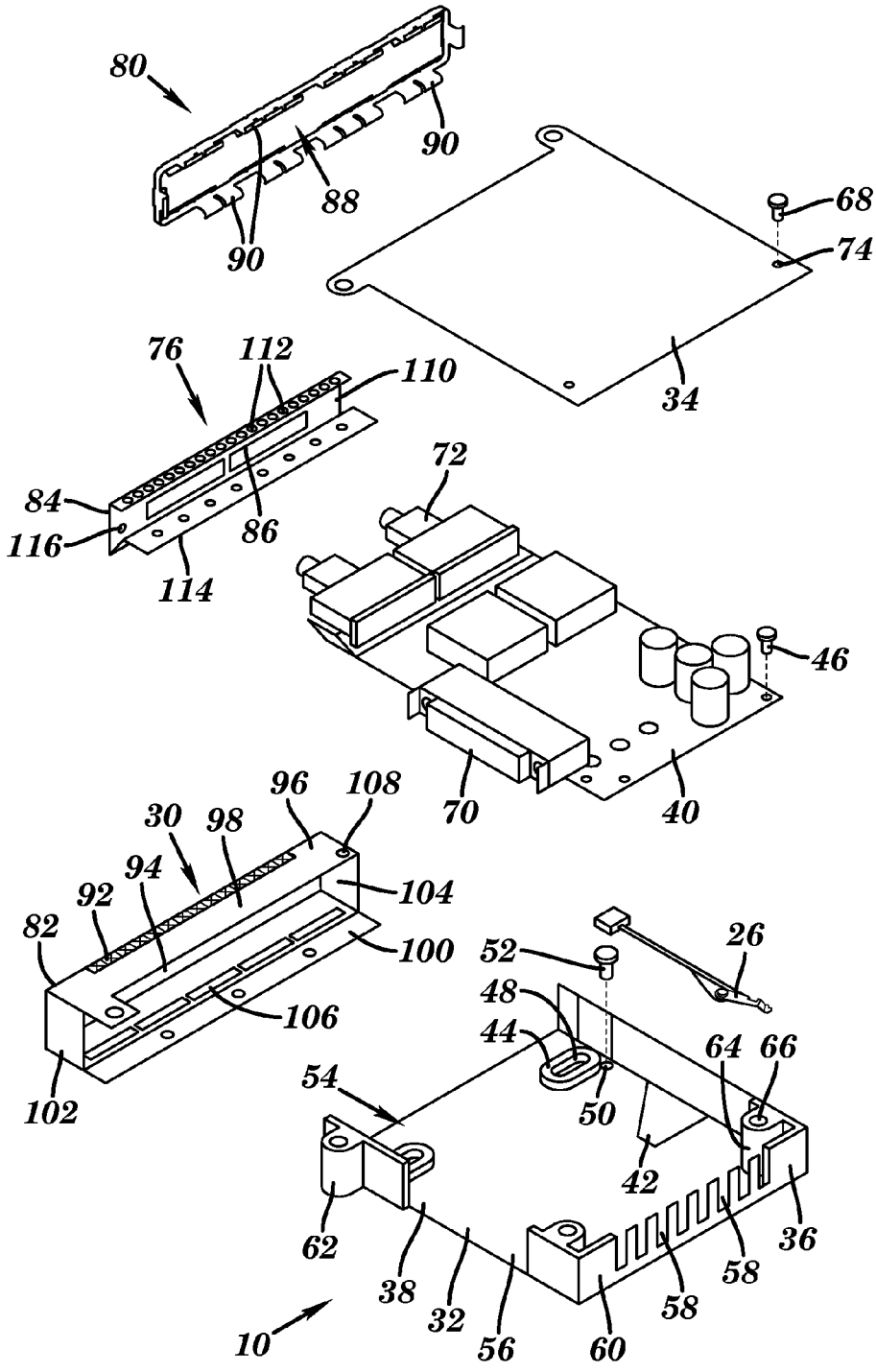
FIG. 3 is an exploded view of the docking cassette of FIG. 2 illustrating electrical modules mounted to a printed circuit card in accordance with an embodiment of the invention.

Referring to FIGS. 2 and 3, docking apparatus 10 for mounting to a printed circuit board (PCB) in computer system 12 is shown, in accordance with an embodiment of the invention. Docking apparatus 10 preferably includes a cassette housing 24, a linkage mechanism 26 and a housing bezel 30. Cassette housing 24 preferably includes a housing base 32, a housing cover 34 and a housing wall 36, wherein housing base 32 and housing wall 36 are non-movably associated with each other and disposed relative to each other so as to define a housing cavity 38 for movably containing a PCC 40.

In accordance with an exemplary embodiment, housing base 32 preferably includes a linkage cavity 42 and four mounting devices 44 for movably holding PCC 40. PCC 40 preferably includes a PCC mounting mechanism 46 and mounting device 44 preferably includes a device opening 48 for slidingly containing PCC mounting mechanism 46, wherein PCC mounting mechanism 46 may be a screw, a pin or any mounting mechanism suitable to the desired end purpose. In addition, housing base 32 preferably includes a linkage mounting receptacle 50 for associating linkage mechanism 26 with housing base 32. In accordance with an exemplary embodiment, although linkage mounting receptacle 50 is preferably a receptacle opening for receiving a linkage mounting screw 52, linkage mounting receptacle 50 may be any receptacle device suitable to the desired end purpose, such as a clip receptacle. In accordance with an exemplary embodiment, it is considered within the scope of the disclosure that PCC 40 may be movably associated with housing base 32 using any device or method suitable to the desired end purpose, such as a screw or pin.

Housing wall 36 preferably includes a cable opening 54, a PCB connector opening 56 and a plurality of vent openings 58. In addition, housing wall 36 preferably includes a first protrusion 60 and a second protrusion 62, wherein first protrusion 60 and second protrusion 62 are disposed so as to lockingly engage with main board 14 of computer system 12. In accordance with an embodiment of the invention, first protrusion 60 and second protrusion 62 are shown as being disposed on housing wall 36. However, it is considered within the scope of the invention that first protrusion 60 and second protrusion 62 may be disposed anywhere on cassette housing 24 in a manner suitable to the desired end purpose. Moreover, housing wall 36 preferably includes at least one mounting structure 64 which defines a threaded cavity 66 for receiving a mounting apparatus 68, such as a screw. In addition, PCB connector opening 56 and cable opening 54 are preferably disposed so as to allow communication with a PCB connector 70 and a PCC cable connections 72 when PCC 40 is disposed within housing cavity 38.

Housing cover 34 preferably includes at least one cover opening 74 disposed so as to allow communication with mounting structure 64 when housing cover 34 is associated with housing wall 36. Cover opening 74 is preferably disposed so as to allow mounting apparatus 68 to communicate with threaded cavity 66 for removably securing housing cover 34 with housing wall 36. Although an exemplary embodiment describes housing cover 34 being removably secured with housing wall 36, it is considered within the scope of the disclosure that housing cover 34 may also be removably secured with housing base 32 and/or housing wall 36 using any mounting device or method suitable to the desired end purpose.

Referring now to FIG. 3, housing bezel 30 preferably includes an inner tailstock bezel 76, a universal EMC gasket 80 and an outer tailstock bezel 82. Inner bezel 76 preferably includes a forward bezel wall 84 having at least one forward opening 86 (FIG. 3). EMC gasket 80 preferably includes at least one opening 88 aligned with the PCC cable connections 72 and plurality of fingers 90 extending away from and into the opening 88 for electrical connection to a housing defining each of the PCC cable connections 72 and inner bezel 76 described more fully below. Outer tailstock bezel 82 preferably includes a tailstock front 92 having a tailstock front opening 94 and a tailstock wall 96 having a tailstock top 98, a tailstock bottom 100 and a tailstock side 102. In accordance with an embodiment of the invention, tailstock front 92 and tailstock wall 96 are preferably non-movably associated with each other so as to form a tailstock cavity 104. In addition, tailstock bottom 100 preferably includes at least one flanged opening 106. Tailstock top 98 also preferably includes at least one tailstock mounting hole 108 for mounting housing bezel 30 to cassette housing 24.

Still referring to FIG. 3, when PCC 40 is operably connected to mounting lip 114 of inner bezel 76, EMC gasket 80 is disposed between an inner face of the inner bezel 76 and PCC cable connections 72 such that the inner bezel 76 and PCC cable connections 72 sandwich the EMC gasket 80 therebetween while allowing the PCC cable connections 72 to extend through the at least one forward opening 86 of the forward bezel wall 84. Inner bezel 76 is disposed such that the inner face facing the electrical or optical modules corresponding to the PCC cable connections 72 electrically engages the PCC 40 via gasket 80. Housing bezel 30 is preferably disposed over cable opening 54 so as to enclose housing cavity 38. In addition, housing bezel 30 is preferably disposed such that tailstock mounting hole 108 is in communication with cover opening 74 and threaded cavity 66. Housing cover 34, linkage mechanism 26 and tailstock mechanism 82 are then securely associated with housing wall 36 using mounting apparatus 68.

Figure 4:
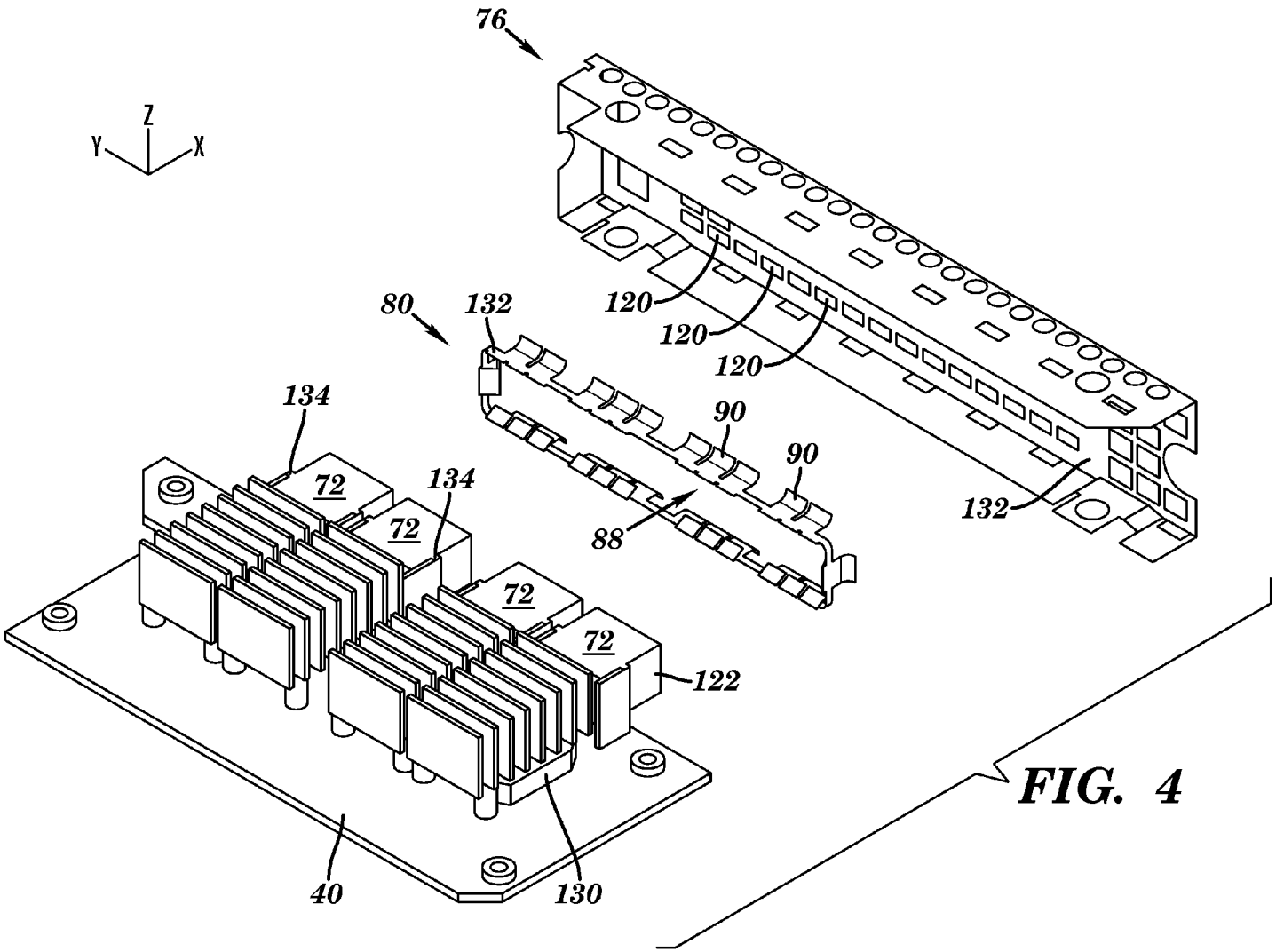
FIG. 4 is a perspective exploded view of a printed circuit card removed from a docking cassette illustrating four optical modules connected thereto, an inner tailstock removed therefrom and an exemplary embodiment of a universal EMC gasket to be disposed between the optical modules and the tailstock, in accordance with the present invention.
Figure 5:
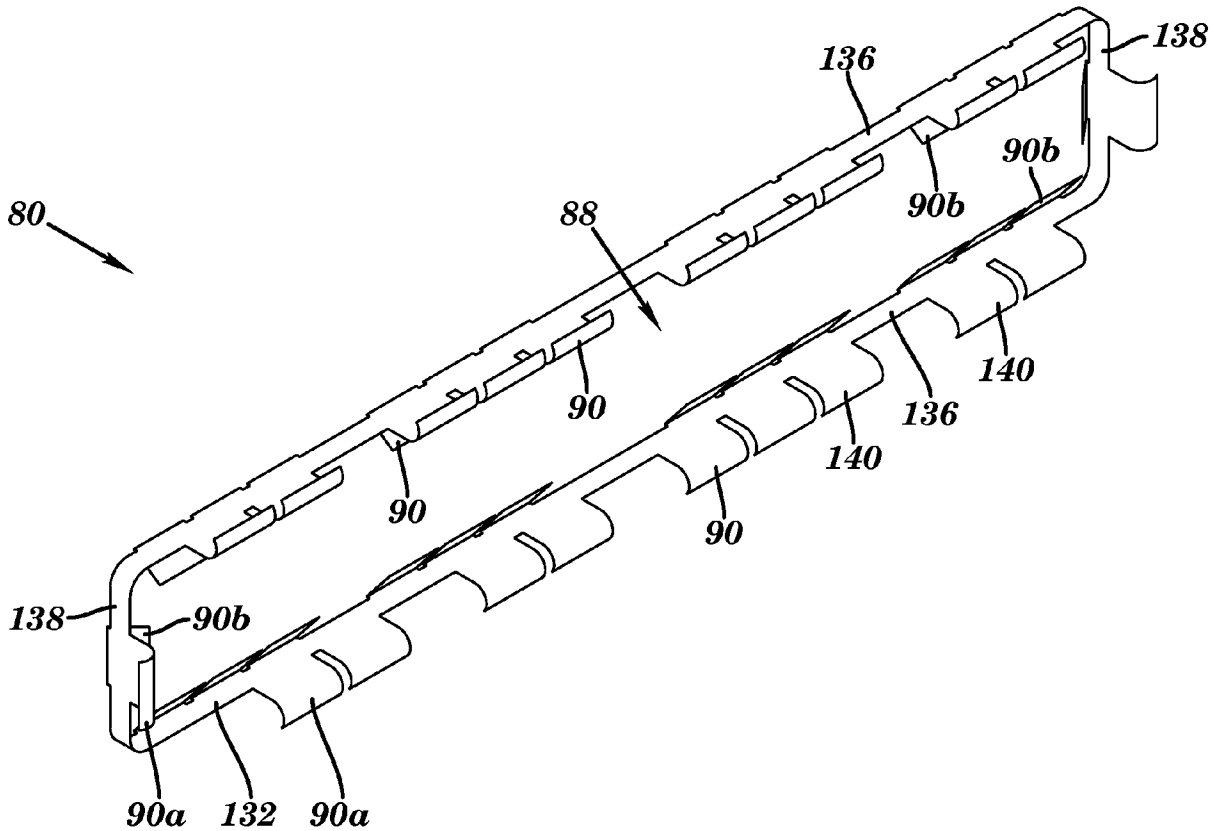
FIG. 5 is an enlarged perspective view of the exemplary embodiment of the universal EMC gasket of FIG. 4.
Figure 6:
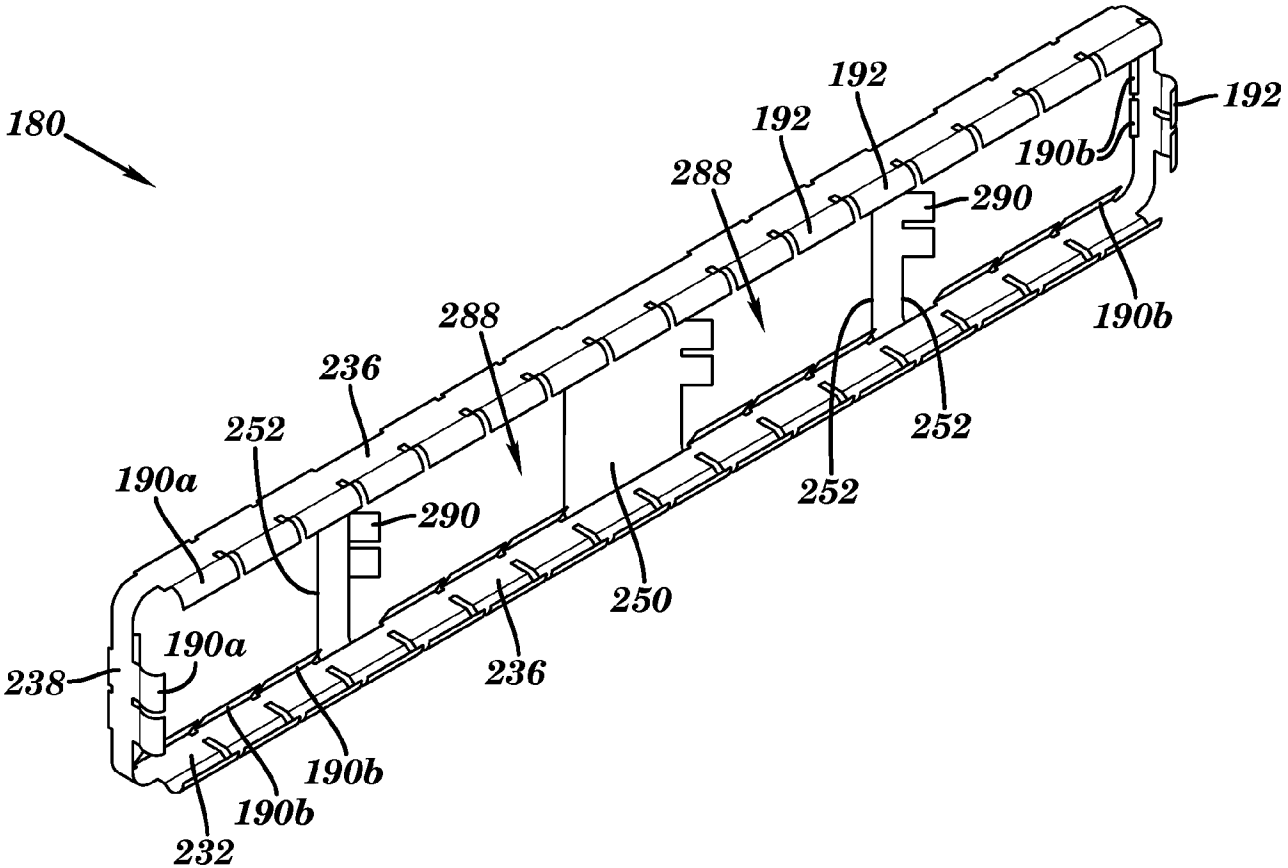
FIG. 6 is a perspective view of an alternative exemplary embodiment of a universal EMC gasket illustrating four openings for receiving a cable housing of a corresponding module in accordance with the present invention.
Figure 8:
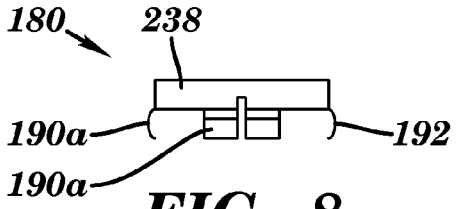
FIG. 8 is a side elevation view illustrating one end of the universal EMC gasket of FIG. 6.
Figure 7:
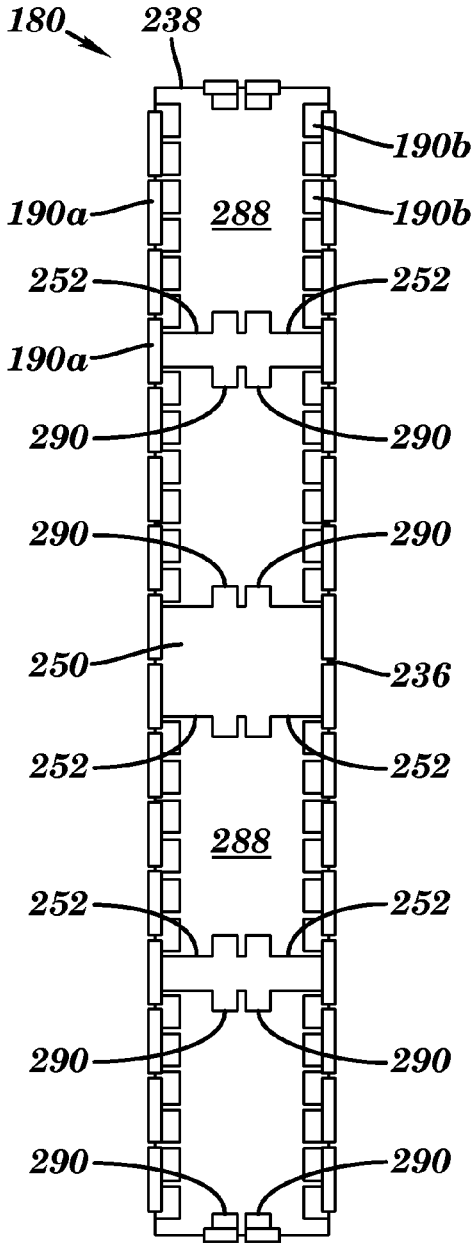
FIG. 7 is a top plan view of the universal EMC gasket of FIG. 6.
Figure 9:
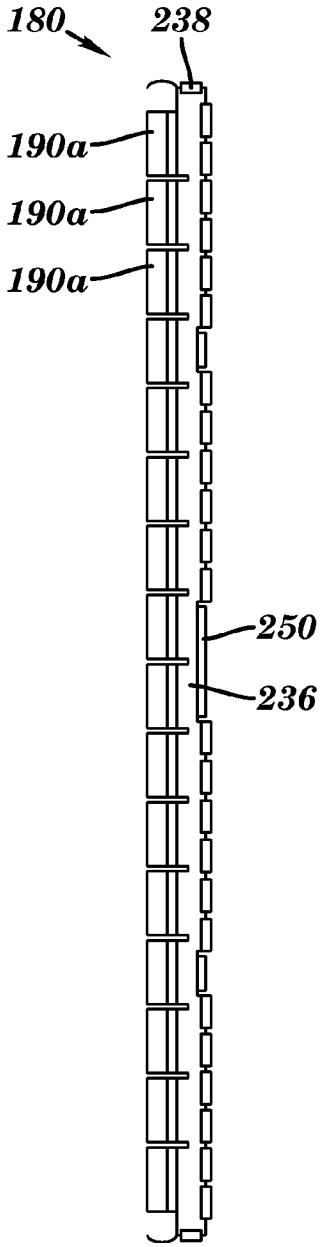
FIG. 9 is another side elevation view illustrating a longitudinal side of the universal EMC gasket of FIG. 6.

Referring now to FIGS. 4 and 5, gasket 80 is configured to provide electrical continuity between PCC 40, inner tailstock bezel 76 and PCC cable connections 72 and thus provide EMC shielding while allowing air to flow through vents 120 of inner tailstock bezel 76. In particular, FIG. 4 illustrates the PCC cable connections 72 as housings 122 of I/O cable connector ports associated with a module 130 mounted to PCC 40. As illustrated in FIG. 4, module 130 is an optical module in an exemplary embodiment, however, any PCC 40 mounted module having a connector port housing 122 for receiving an I/O cable is contemplated. For example, the modules associated with the PCC cable connections 72 of FIGS. 1-3 are electrical modules rather than optical modules.

Gasket 80 is an electromagnetic gasket formed of a conductive shell 132. The conductive shell is configured as an open box structure defining at least the one opening 88 in which to receive a PCC cable connection 72 therethrough and make electrical contact with an inner face 134 of inner tailstock bezel 76 via the plurality of fingers 90. In an exemplary embodiment as shown, EMC gasket 80 is configured as a single one piece open box structure defining a single opening 88 in which to receive a plurality of PCC cable connections 72 therethrough. Opening 88 is adapted to receive at least a connector port housing 122 of each PCC cable connection 72 therein leaving fingers 44 extending from a perimeter of EMC gasket 80 exposed. In this manner, EMC gasket 80 is intermediate inner tailstock bezel 76 and a shoulder 134 defining a portion of each module 130 from which a respective connector port housing extends.

The conductive shell 132 includes a pair of side walls 136 and a pair of end walls 138 extending from the side walls 136. The pair of side walls 136 and end walls 138 define the at least one opening 88. The pair of side walls 136 and the end walls 138 have at least one finger 90 positioned thereon for each opening 88. Each of the fingers 90 is configured as an outward bias or configured as an inward bias. However, it is contemplated that each finger 90 may be configured to provide both an inward and outward bias as suitable for the desired end purpose.

A finger 90 configured with an outward bias is configured to electrically connect to the inner tailstock bezel 76. A finger 90 configured with an inward bias electrically connects with connector port housing 122 thereby ensuring electrical continuity between the inner tailstock bezel 76 and module 130 connected to PCC 40. The gasket 80 is preferably formed of a single one piece electrically conductive material fully contained between the inner tailstock bezel 76 and connector port housing 122.

The outward bias for electrical connection to the inner tailstock bezel 76 includes a first plurality of conductive fingers **90*a* extending from the pair of side walls 136 and end walls 138. The first plurality of conductive fingers 90*a* surrounding an entire perimeter defining the opening 88 and extend outside thereof. The inward bias includes a second plurality of conductive fingers 90*b* extending from the pair of side walls 136 and end walls 138. The second plurality of conductive fingers 90*b* surround an entire perimeter defining the opening 88 and extend inside thereof. As described above, the first and second plurality of conductive fingers 90*a*, 90*b* provide a continuous ground path between the inner tailstock bezel 76 and the connector port housing 122**.

Still referring to FIGS. 4 and 5, an intermediate portion 140 of each of the first plurality of conductive fingers **90*a* is a bight portion configured to flex allowing differently configured connector ports 122 to be used while still malting a suitable ground contact. In particular, the flexing of the first plurality of conductive fingers 90***a* allows use of differently configured modules 130 having different connector port housings that vary in the Y-direction as illustrated in FIG. 4. In this manner, the flexible first plurality of conductive fingers 90*a* compensates for variable distance between the shoulder 134 of the connector port and the inner face 132 of the inner tailstock bezel 76. It will also be recognized that a terminal end of each of the first plurality of conductive fingers 90*a* may be rounded to facilitate compression thereof.

Further, each of the second plurality of conductive fingers 90*b* is configured as a tab extending at an acute angle from a respective sidewall, as illustrated in FIGS. 4 and 5. In particular, the angled tab extending into opening 88 allows flexing of each respective second plurality of conductive fingers 90*b* to allow the use of differently configured modules 130 having different connector port housings that vary in the X- and Z-directions as illustrated in FIG. 4. In this manner, the flexible angle tabs as the second plurality of conductive fingers 90*b* compensate for variably sized outer perimeters of differently configured connector port housings 122 in the X- and Z-directions.

Referring now to FIGS. 6-10, an alternative exemplary embodiment of an EMC gasket 180 is illustrated. This present embodiment of gasket 180 is similar to gasket 80 described with reference to FIGS. 4 and 5, but for the addition of a bottom wall extending from the sidewalls and a third plurality of conductive fingers extending from the bottom wall. Therefore, duplicative elements will not be described in detail and differences therebetween will be pointed out.

More specifically, gasket 180 includes a conductive shell 232 defined by a pair of side walls 236 and a pair of end walls 238 extending from the side walls 236. At least one bottom wall 250 extends from corresponding portions of the pair of sidewalls 236. Each bottom wall 250 defines adjacent openings 288 for receiving a respective connector port housing 122 therein. Each bottom wall 250 includes a third plurality of conductive fingers 290 extending from opposing edges 252 defining each bottom wall 250 and extending inside of an opening 288 defined by each bottom wall 250.

Like the previous embodiment, gasket 180 includes a first plurality of conductive fingers 190*a* extending from the pair of side walls 236 and end walls 238 as an outward bias. The first plurality of conductive fingers 190*a* surround an entire perimeter defined by the side and end walls, 236, 238 and extend outside of the perimeter. Gasket 180 further includes a second plurality of conductive fingers 190*b* extending from the pair of side walls 136 and end walls 138 as the inward bias. The second plurality of conductive fingers 190*b* surround an entire perimeter defined by the side and end walls, 236, 238 and extend inside of the perimeter. As described above, the first and second plurality of conductive fingers 190*a*, 190*b* provide a continuous ground path between the inner tailstock bezel 76 and the connector port housing 122.

Each of the second and third plurality of conductive fingers 190*b* and 290 are configured as a tab extending at an angle from a respective sidewall or bottom wall, respectively. The tab extends in a plane that is at an angle to a plane that is coplanar with the at least one bottom wall 250.

An intermediate portion of each of the first plurality of conductive fingers 190*a* includes a bight portion 192 configured to flex allowing differently configured connector ports 122 to be used while still making a suitable ground contact, as in the first plurality of conductive fingers 90*a* described with reference to FIGS. 4 and 5. However, it will be noted that the bight portion 192 is opposite to the bight portion of FIGS. 4 and 5. In addition, a terminal end of each of the first plurality of conductive fingers 190*a* is rounded to facilitate compression thereof at it contacts inner face 132 of bezel 76.

Figure 10:
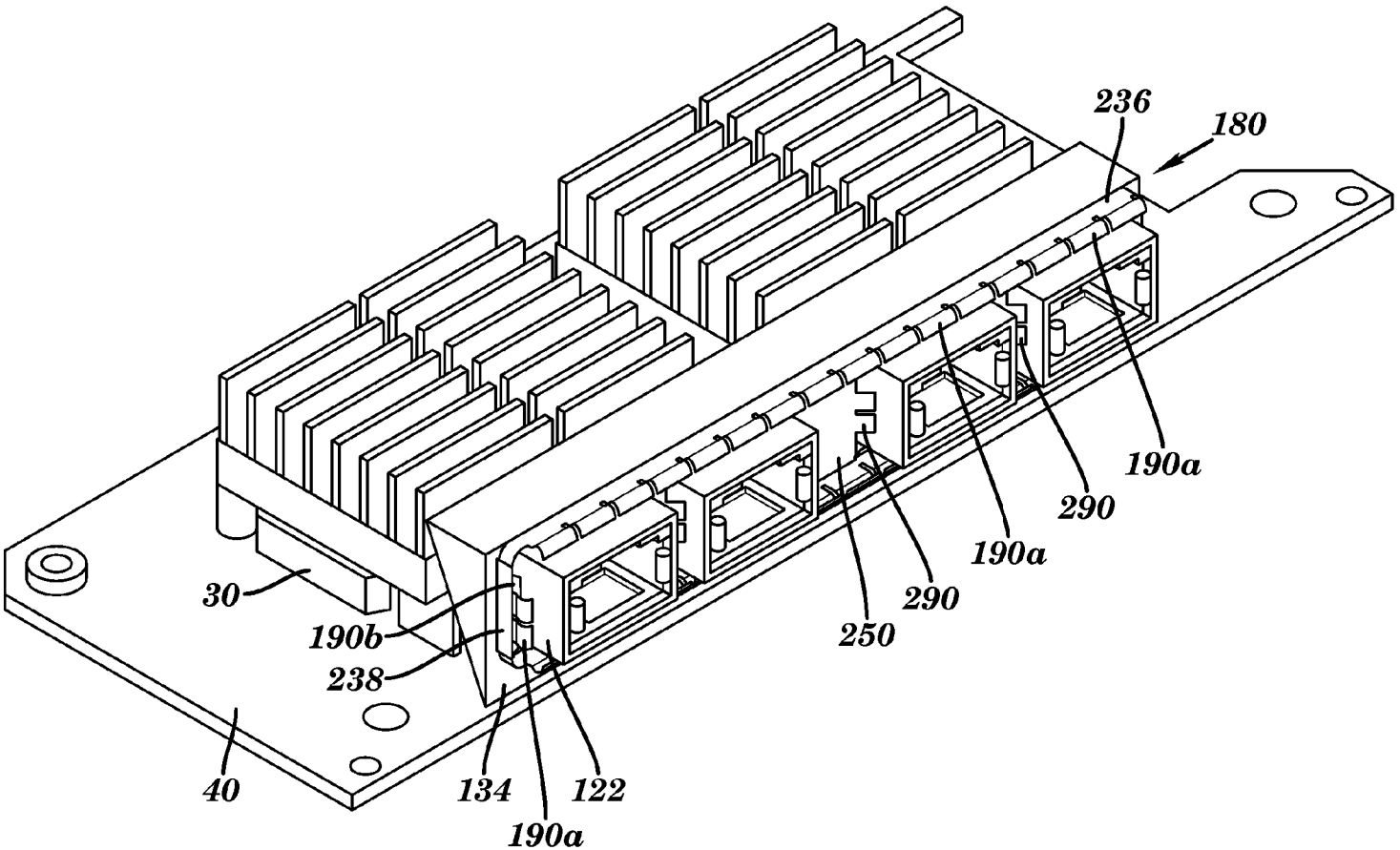
FIG. 10 is a perspective view illustrating four optical modules on a printed circuit card and the exemplary embodiment of the universal EMC gasket of FIG. 6 disposed on the cable housings of the optical modules in accordance with the present invention.

FIG. 10 illustrates gasket 180 assembled with the modules 30 mounted to PCC 40. The terminal ends defining one end of the side walls and end walls 236 and 238 abut the shoulder 134 of the connector port housing 122. When the inner tailstock bezel is assembled with the modules 30 with the gasket 180 disposed therebetween, the gasket 180 removably closes an electrical gap formed between differently configured connector port housings 122 and the inner tailstock bezel 76 to form electrical continuity therebetween while being sandwiched between the inner tailstock bezel 76 and a shoulder 134 defining each connector port housing 122.

The inventive EMC gasket is thus quickly and easily assembled with differently configured connector port housings having multiple X, Y and Z axis variations from different vendors. The universal EMC gasket virtually eliminates loss of electrical contact between the inner tailstock bezel and the modules due to multiple X, Y and Z variations in the dimensions of the corresponding connector port housings from different vendors, ensuring continuous grounding and shielding. Therefore with use of the inventive universal EMC gasket the negative effects of EMC and electrostatic discharge (ESD) are significantly reduced.

The first, second and third plurality of conductive fingers 90, 190, 290 are compressible to provide electrical continuity between inner bezel 76 and corresponding connector port housing 122 when gasket 80, 180 is disposed therebetween providing air flow and EMC sealing, while allowing universal fit and adaptability. Compressible fingers 90, 190, 290 allow universal fit and adaptability because they allow installation with differently dimensioned connector port housings having multiple X, Y and Z axis variations while maintaining EMC sealing as a result of the compressible fingers extending from a surface of gasket 80 to provide contact with inner bezel 76 and respective connector port housings 122.

In addition, although the plurality of conductive fingers have been described as forming an angled tab or including an intermediate bight portion, other configurations, such as, including for example, but not limited to, a finger having an S or C shape structure, and the like, may be alternatively employed.

In accordance with exemplary embodiments of the invention and referring to Figures, EMC gasket 80, 180 is preferably constructed from a rigid material having sufficient strength and electromagnetic compatibility properties, such as beryllium copper and/or stainless steel. However, it is considered within the scope of the invention that gasket 80 may be constructed from any material suitable to the desired end purpose.

Because of its simple design, the inventive universal EMC gasket may be inexpensively manufactured from a single sheet of material. The EMC gasket 32 is preferably made of a single one piece thin sheet, e.g., 0.005 to 0.010 inches thick, of stainless steel or beryllium copper. Other materials may be similarly employed. The plurality of conductive fingers are formed surrounding an entire perimeter of at least one opening defined thereby when the thin sheet is cut/stamped and folded.

It will also be understood that although EMC gasket has been described having a inward and outward bias structure disposed relative to at least one opening formed by the conductive shell to provide electrical continuity between inner bezel 76 and a corresponding connector port housing 122 extending therethrough, a different configuration and/or number of conductive fingers are contemplated and do not necessarily extend outside of the at least one opening as described above for a first plurality of conductive fingers in one exemplary embodiment. The EMC gasket described herein is a movable seal that allows for PCC insertion and extraction with the docking cassette that is universally adaptable for use with differently configured housing bezels and connector port housings having multiple X, Y and/or Z axis variations, while still making suitable ground contact and allowing proper air flow therethrough.

In accordance with an embodiment of the invention, inner tailstock bezel 76 and connector port housing 122 are preferably constructed from a rigid material having sufficient strength, such as steel and/or stainless steel. However, it is considered within the scope of the invention that inner tailstock bezel 76 and connector port housing 122 may be constructed from any material suitable to the desired end purpose.

Although the present invention has been described in accordance with a docking cassette as it relates with a computer system, it will be understood that the present invention is not limited thereto and that the present invention may be incorporated for providing a dynamic universal EMC gasket in for a device associated with any electrical enclosure.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electromagnetic gasket comprising:

a conductive shell having a pair of side walls and end walls extending therefrom defining at least one opening, the pair of side walls and the end walls having at least one outward bias and at least one inward bias positioned thereon for each of the at least one opening, wherein said outward bias is configured to electrically connect to an inner tailstock of an electrical enclosure and includes a first plurality of conductive fingers configured in the pair of side walls and end walls, the first plurality of conductive fingers surrounding an entire perimeter defining the at least one opening and extending outside thereof, the at least one opening is configured to receive a connector port housing of a module therein, and the at least one inward bias electrically connects the connector port housing to the inner tailstock of the electrical enclosure and includes a second plurality of conductive fingers configured in the pair of side walls and end walls, the second plurality of conductive fingers surrounding an entire perimeter defining the at least one opening and extending inside thereof.

2. The gasket of claim 1, wherein the conductive shell is a single one piece electrically conductive material fully contained between the inner tailstock and connector port housing.

3. The gasket of claim 1, wherein the first and second plurality of conductive fingers provide a continuous ground path between the inner tailstock and the connector port.

4. The gasket of claim 1 further comprising at least one bottom wall extending from corresponding portions of the pair of sidewalls, each bottom wall having a third plurality of conductive fingers extending from opposing edges defining each bottom wall and extending inside of an opening defined by each bottom wall.

5. The gasket of claim 4, wherein each bottom wall defines two contiguous openings for receiving a respective connector port housing therein.

6. The gasket of claim 4, wherein each of the second and third plurality of conductive fingers are configured as a tab extending at an angle from a respective sidewall or bottom wall away from a plane coplanar with the at least one bottom wall.

7. The gasket of claim 6, wherein an intermediate portion of each of the first plurality of conductive fingers is a bight portion configured to flex allowing differently configured connector ports to be used while still making a suitable ground contact.

8. The gasket of claim 6, wherein a terminal end of each of the first plurality of conductive fingers is rounded to facilitate compression of the first plurality of conductive fingers.

9. The gasket of claim 1, wherein the inner tailstock, the conductive shell, and the connector port housing are made from a metallic material.

10. The gasket of claim 9, wherein the metal conductive shell is one of BeCu and stainless steel.

11. The gasket of claim 1, wherein the conductive shell ensures electrical engagement between the inner tailstock and differently configured connector port housings of a module that is in electrical contact with a printed circuit card, the printed circuit card is in electrical contact with a housing base of a docking cassette, and the housing base is referenced to ground.

12. The gasket of claim 11, wherein the at least one inward bias and outward bias provide EMC sealing for multiple connector port housings having variable dimensions with respect to at least one of the X, Y and Z axis of the connector port housings.

13. The gasket of claim 11, wherein the conductive shell removably closes an electrical gap formed between differently configured connector port housings and the inner tailstock to form electrical continuity therebetween while being sandwiched between the inner tailstock and a shoulder defining each connector port housing.

14. The gasket of claim 1, wherein the electrical enclosure is a docking cassette for a computer.

15. The gasket of claim 1, wherein the module is one of an electrical module and an optical module.

16. An electromagnetic gasket comprising:

a conductive shell having a pair of side walls and end walls extending therefrom defining at least one opening, the pair of side walls and the end walls having at least one outward bias and at least one inward bias positioned thereon for each of the at least one opening, the conductive shell ensuring electrical engagement between the inner tailstock and differently configured connector port housings of a module that is in electrical contact with a printed circuit card, the printed circuit card being in electrical contact with a housing base of a docking cassette, and the housing base being referenced to ground, wherein said outward bias is configured to electrically connect to an inner tailstock of an electrical enclosure and the at least one opening is configured to receive a connector port housing of a module therein, the at least one inward bias electrically connecting the connector port housing to the inner tailstock of the electrical enclosure; and wherein the at least one inward bias and outward bias provide EMC sealing for multiple connector port housings having variable dimensions with respect to at least one of the X, Y and Z axis of the connector port housings.

17. The gasket of claim 16, wherein the at least one outward bias includes a first plurality of conductive fingers configured in the pair of side walls and end walls, the first plurality of conductive fingers surrounding an entire perimeter defining the at least one opening and extending outside thereof, and the at least one inward bias includes a second plurality of conductive fingers configured in the pair of side walls and end walls, the second plurality of conductive fingers surrounding an entire perimeter defining the at least one opening and extending inside thereof.

18. The gasket of claim 17, wherein the first and second plurality of conductive fingers provide a continuous ground path between the inner tailstock and the connector port.

19. The gasket of claim 17 further comprising at least one bottom wall extending from corresponding portions of the pair of sidewalls, each bottom wall having a third plurality of conductive fingers extending from opposing edges defining each bottom wall and extending inside of an opening defined by each bottom wall.

* * * * *